US005813268A

United States Patent [19]

Donini et al.

[11] Patent Number: 5,813,268

[45] Date of Patent: Sep. 29, 1998

[54] BLOCK TO PROVIDE CURVATURE AND BALANCING FOR FOUR-HIGH ROLLING MILL STANDS TO PROCESS STRIP OR PLATE

[75] Inventors: Estore Donini, Vimercate; Fausto Drigani, Zugliano, both of Italy

[73] Assignee: Danieli & C. Officine Meccaniche SpA, Buttrio, Italy

[21] Appl. No.: 653,396

[22] Filed: May 24, 1996

[30] Foreign Application Priority Data

May 25, 1995 [IT] Italy ..... UD95A0095

[51] Int. Cl.[6] ..... B21B 13/14; B21B 29/00; B21B 31/00

[52] U.S. Cl. ..... 72/241.8; 72/237

[58] Field of Search ..... 72/237, 241.4, 72/241.8, 244, 246, 245, 247, 243, 238

[56] References Cited

U.S. PATENT DOCUMENTS

| | | | |
|---|---|---|---|
| 3,307,386 | 3/1967 | Ward et al. | 72/241.2 |
| 4,038,857 | 8/1977 | Eibe et al. . | |
| 4,202,192 | 5/1980 | Haneda et al. | 72/244 |
| 4,676,085 | 6/1987 | Ellis | 72/245 |
| 4,773,246 | 9/1988 | Perret | 72/241.8 |
| 4,976,128 | 12/1990 | Tajima | 72/244 |

FOREIGN PATENT DOCUMENTS

| | | |
|---|---|---|
| 1363766 | 9/1964 | France . |
| 1527689 | 3/1970 | Germany . |

OTHER PUBLICATIONS

Patent Abstracts of Japan vol. 8 No. 57 (M–283) 15 Mar. 1984 & JP A–58 209405 (Ishikawajima Harima) 6 Dec. 1983 Abstract.

Patent Abstracts of Japan vol. 5 No. 90 (M–762) 12 Jun. 1981 & JP–A–45 036303 (Kobe Seikosho) 2 Apr. 1984 Abstract Figs.

Patent Abstracts of Japan vol. 8, No. 160 (M–312) 25 Jul. 1984 & JP–A–59 056910 (Kawasaki) 2 Apr. 1984, abstract, figures.

*Primary Examiner*—Lowell A. Larson
*Assistant Examiner*—Rodney A. Butler
*Attorney, Agent, or Firm*—Antonelli, Terry, Stout & Kraus, LLP

[57] ABSTRACT

Block to provide curvature and balancing, which is suitable to impart an "IN" or "OUT" pre-curvature to processing rolls (11) of a four-high rolling mill stand (12) comprising a pair of processing rolls, lower (11*a*) and upper (11*b*) rolls respectively, each of which cooperates with a relative back-up roll (13*a*, 13*b*), the processing rolls (11*a*, 11*b*) and back-up rolls (13*a*, 13*b*) cooperating at their two ends with respective chocks (15*a*, 15*b*) and (16*a*, 16*b*) and relative bearings, the block comprising at least one lower rib (18*a*, 118*a*) and one upper rib (18*b*, 118*b*) including on their respective inner surfaces curvature jack means (20, 120) cooperating with the opposite surfaces of the chocks (15) of the processing rolls (11), supporting jacks (14) being included and cooperating with the chocks (16*a*, 16*b*) of the back-up rolls (13*a*, 13*b*), at least one rib (18) including on its outer surface compensation jack means (21, 121) which are actuated when an "OUT" pre-curvature is imparted to at least one processing roll (11) associated with the block (10), the compensation jack means (21, 121) acting on the chocks (16) of the corresponding back-up roll (13).

7 Claims, 2 Drawing Sheets

BLOCK TO PROVIDE CURVATURE AND BALANCING FOR FOUR-HIGH ROLLING MILL STANDS TO PROCESS STRIP OR PLATE

BACKGROUND OF THE INVENTION

This invention concerns a block to provide curvature and balancing for four-high rolling mill stands to produce strip or plate.

The curvature and balancing block according to the invention is employed to create in relation to the rolling plane a pre-curvature of the rolling rolls inwards, namely towards the other roll "IN" or outwards "OUT" so as to oppose or enhance the deflections generated in the processing rolls during the rolling operations.

The field of rolling covers the problem caused by the deflections generated by the rolling force in the processing rolls.

To reduce these deflections are used four-high rolling mill stands which comprise two back-up rolls, an upper back-up roll and a lower back-up roll respectively, which act on the respective processing rolls and through which is applied the rolling pressure against the processing rolls.

U.S. Pat. No. 4,038,857 discloses curvature and balancing blocks which are arranged as counterparts and laterally on one side and the other of the chocks of the rolls and which have a substantially E-shaped cross-section and with which there cooperate the chocks associated with the ends of the processing rolls and back-up rolls; these blocks support a plurality of jacks to provide curvature and balancing.

This E-shaped block defines with its three ribs, namely an upper, intermediate and lower rib respectively, two spaces in which are positioned respective lateral extensions provided in the chocks of the processing rolls.

These E-shaped blocks also include upper and lower supporting jacks with which act on the chocks of the back-up rolls.

To be more exact, in the E-shaped curvature and balancing blocks the jacks to provide curvature and balancing are arranged respectively on the lower surface of the upper rib, on the upper surface of the lower rib and on the lower and upper surfaces of the central rib; the purpose is to act from above or from below, according to the requirements, on the lateral extensions of the chocks positioned within the spaces defined by the ribs of the E-shaped block.

Depending on which curvature and balancing jacks are actuated, a pre-curvature of the axis of the processing roll is generated upwards or downwards in relation to the rolling plane according to the particular rolling requirements.

Conventionally the curvature of the rolls facing towards the rolling plane of the rolling mill stand is defined as "IN", whereas the curvature of the rolls facing away from the rolling plane is defined as "OUT".

These E-shaped blocks, however, entail a problem linked to the fact that, when the outer jacks, namely the jacks associated with the lower surface of the upper rib and with the upper surface of the lower rib, are actuated to determine an "OUT" curvature of the processing rolls, these upper and lower ribs of the E-shaped block tend, under the action exerted by the outer jacks, to yield and to be deformed outwards resiliently.

This causes the necessity of reducing the maximum applicable force generated by the jacks and therefore the action of the "OUT" curvature of the processing roll.

Another problems of these E-shaped blocks is due to the fact that the processing rolls in the rolling mill stands may be traversed axially to prevent the zone of the processing roll in contact with the edge of the strip or plate from always being the same zone, with a resulting wear and excessive localized deformations of the processing rolls.

This axial traversing has the effect that the force of feedback arising from the action of the curvature jacks may be offset from the axis of the bearings supporting the processing rolls associated with the relative chocks, thus causing problems of the working life of the bearings of the processing rolls.

So as to reduce the damage to those bearings, it is necessary to reduce the force of "OUT" curvature acting on the processing rolls.

The wear on the processing rolls where E-shaped blocks are involved is limited by the geometric configuration of the E-shaped block and of the chocks of the processing rolls.

It is therefore necessary to restrict the wear on the processing rolls with a resulting increase in the production costs.

FR-A-1.363.766 too discloses a device substantially like that described above with the difference that the curvature and balancing block is an integral part of the supporting structure of the rolling mill stand and is substantially C-shaped; on the chock of the lower processing roll there acts only a jack from above, and only an "IN" curvature can be generated in that lower processing roll.

JP-A-59-056910 discloses a curvature and balancing block which includes jacks that can generate only an "IN" curvature in the processing rolls.

SUMMARY OF THE INVENTION

The present applicants have designed, tested and embodied this invention to overcome the shortcomings of the state of the art and to achieve further advantages.

The purpose of this invention is to provide a curvature and balancing block fitted to a four-high rolling mill stand for the processing of strip or plate so as to generate the required pre-curvature in the processing rolls.

The block according to the invention always ensures a correct balance and eliminates the unbalanced forces acting on the bearings within the chocks of the processing rolls.

The rolling mill stands to which the curvature and balancing blocks according to the invention are applied include advantageously hydraulic actuator capsules positioned between the chock of the lower or upper back-up roll and the relative housing, these capsules being actuated to control the rolls in position.

The curvature and balancing block according to the invention makes it possible to ensure that the feedback exerted by the chock is substantially always positioned on the centreline of the bearing of the processing roll.

Moreover, the thrust exerted by the balancing jacks is substantially on the same axis as the hydraulic actuator capsules associated with the housings, irrespective of the axial position of the processing rolls, thus ensuring a correct balancing and an excellent stability of the rolling mill stand.

The block according to the invention makes possible the elimination of the resilient deflections of the upper and lower ribs of the blocks of the state of the art, these deflections being due to unbalanced thrusts generated by the curvature jacks when an "OUT" curvature is imparted to the processing rolls.

The block according to the invention includes, at least on the outer surface of the upper or lower rib of the block, compensation jack means which have the function of opposing the unbalanced thrusts acting on that rib and of eliminating the deflection.

With the block according to the invention the ribs are no longer subject to high stresses.

In a first embodiment of the invention the curvature and balancing block has a C-shaped conformation and is associated with the ends of a processing roll, whether that roll be the upper or lower processing roll.

To be more exact, the C-shaped block includes curvature jack means arranged on the inner surface of the respective upper and lower ribs and on the outer surface of the rib associated with the other processing roll, while the other rib includes on its outer surface compensation jack means.

By acting on the opposed curvature jack means, it is possible to impart an "IN" curvature to the two processing rolls.

When the jack means associated with the other inner surface of the rib are actuated, an "OUT" curvature is imparted to the relative processing roll associated with the C-shaped block, and the resulting thrust is compensated by the relative compensation jack means in such a way that the curvature and balancing block is properly balanced and is not subject to deformations.

With this embodiment of the invention it is possible to alter the diameter of the processing rolls within a 10% range of diameters as compared to the nominal diameter of the processing rolls without having constraints of a geometric type caused by the blocks and by the chocks.

According to another embodiment of the invention the curvature and balancing block according to the invention has an E-shaped conformation, in which the respective upper and lower ribs include compensation jack means associated with the respective outer surfaces of those ribs.

The compensation jack means associated respectively with the upper surface of the upper rib and the lower surface of the lower rib have the task of balancing the thrust generated by the curvature jack means when an "OUT" curvature is imparted to the processing rolls.

The compensation jack means prevent the respective upper and lower ribs of the E-shaped block from being stressed with high values.

In an advantageous form of embodiment of the curvature and balancing block according to the invention, both in the C-shaped embodiment and in the E-shaped embodiment, the jack means consist of two parallel actuators spaced apart along the axis of the processing rolls.

In this particular form of embodiment it is possible to distribute the thrust exerted by the two actuators in such a way that the resulting action is always positioned on the axis of the bearings, irrespective of the axial position of the processing rolls within that rolling mill stand.

A correct functioning of those bearings is ensured in this way.

With the block according to the invention the values of the force of curvature, which is a function of the loads which can be exerted on the processing rolls, can be increased considerably.

In particular, with the E-shaped block according to the invention an increase of 70% or more of the applicable forces of curvature is achieved as compared to the conventional blocks of the state of the art, whereas with the C-shaped block according to the invention the increase may even reach 25% or more.

According to a variant two-positional attachment means are included in the curvature and balancing block according to the invention.

These attachment means in a first position enable the chock to be clamped axially to the relative curvature and balancing block so as to carry out the shifting, or axial movement, of the rolls so as to alter the processing surface of the rolls.

These attachment means in a second position clamp the curvature and balancing blocks to the outer housings and free the relative chock and therefore release the rolls, which can thus be withdrawn from the rolling mill stand.

BRIEF DESCRIPTION OF THE DRAWINGS

The attached figures are given as a non-restrictive example and show two preferred embodiments of the invention as follows.

DETAILED DESCRIPTION OF THE PREFERRED EMBODIMENTS

Figure 1:
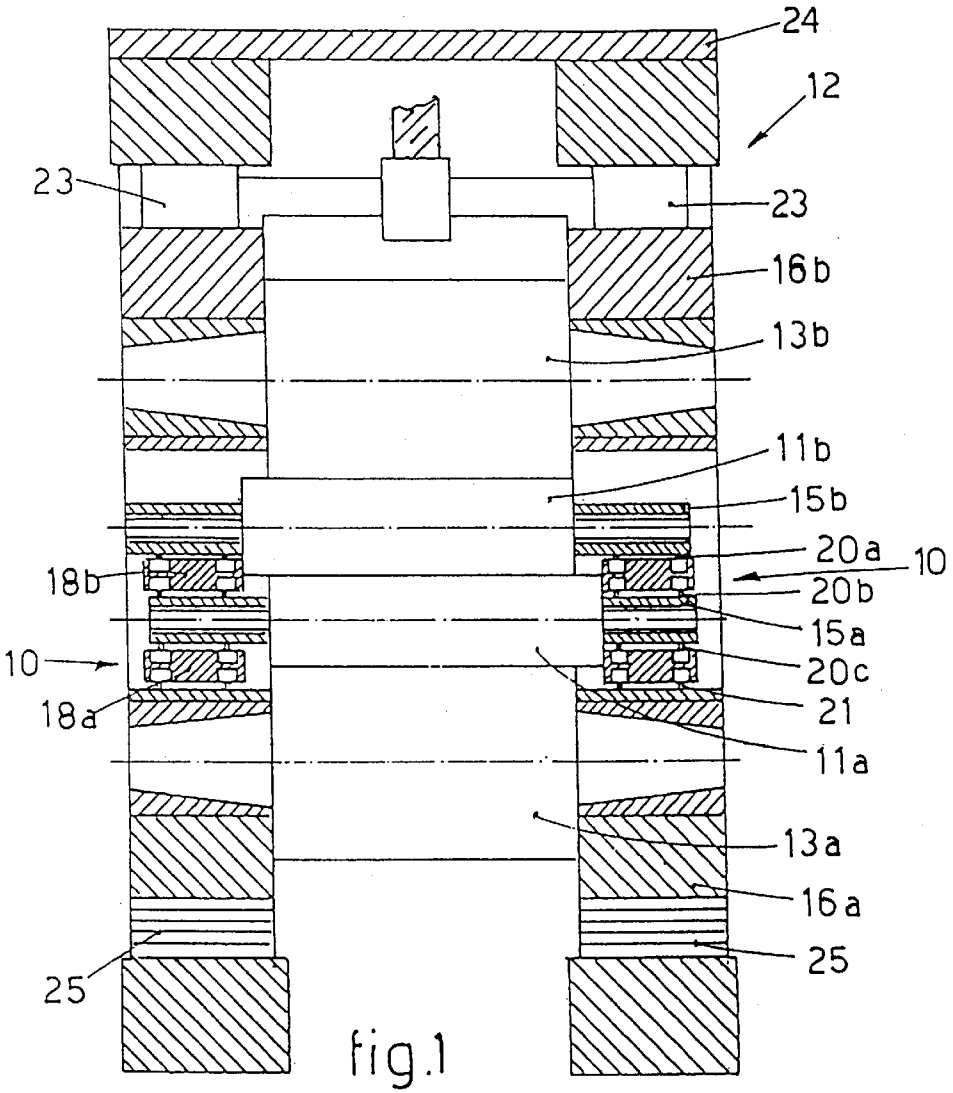
FIG. 1 is a diagram of a partly cutaway front view of a rolling mill stand using a first form of embodiment of the curvature and balancing block according to the invention.

In the figures the reference number 10 denotes generally a curvature and balancing block associated with processing rolls 11 of a rolling mill stand 12 which comprises a pair of processing rolls 11, each of which cooperates with a respective back-up roll 13.

The block 10 according to the invention is fitted to the rolling mill stand 12 so as to determine a desired curvature in the processing rolls 11 and to balance the thrusts due to the rolling.

In this case the rolling mill stand 12 comprises a pair of processing rolls 11, namely a lower roll 11*a* and an upper roll 11*b* respectively, each of which is in contact with a respective back-up roll 13*a* and 13*b*; the ends of those rolls 11, 13 are associated with respective chocks 15, 16 associated in turn with the uprights of the housings 17 of the rolling mill stand 12.

Figure 2:
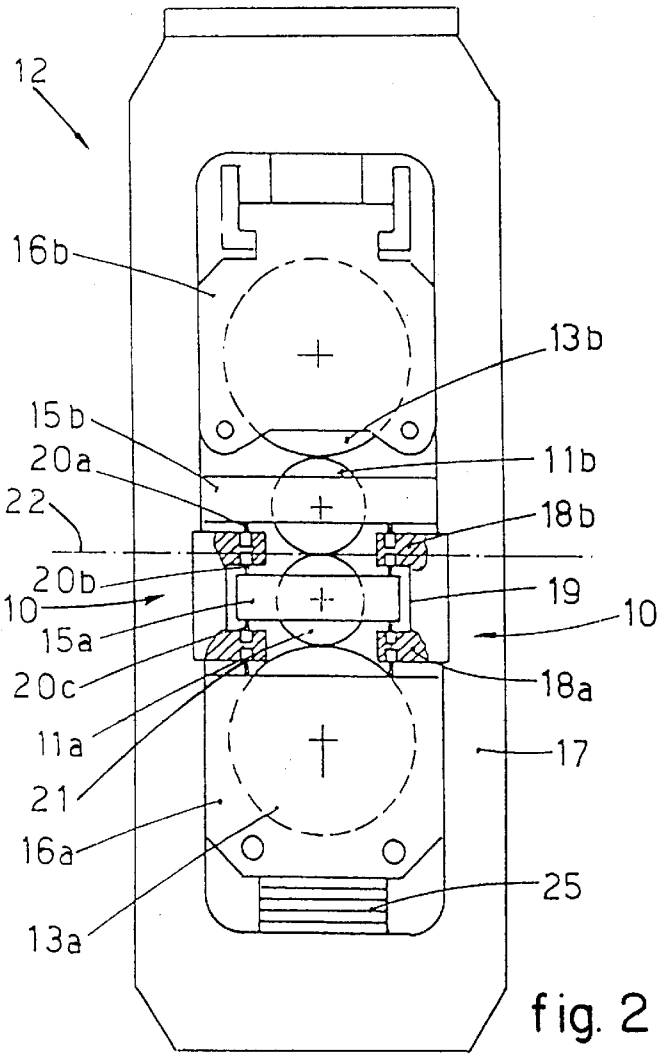
FIG. 2 is a side view of the curvature and balancing block of FIG. 1.

In a first form of embodiment shown diagrammatically in FIGS. 1 and 2 the block 10 has a C-shaped transverse conformation and is applied to only one processing roll, which in this case is the lower processing roll 11*a*.

The C-shaped block 10 includes a lower rib 18*a* and an upper rib 18*b* defining between then an intermediate space 19 with which there cooperates a chock 15*a* associated with the lower processing roll 11*a*.

The upper rib 18*b* includes on its upper side first jack means 20*a* to provide curvature of the upper processing roll 11*b* and on its lower side second jack means 20*b* to provide curvature of the lower processing roll 11*a*.

The lower rib 18*a* includes on its upper side third jack means 20*c* to provide curvature of the lower processing roll 11*a* and on its lower side compensation jack means 21.

The first curvature jack means 20*a* and the second curvature jack means 20*b* are actuated to impart an "IN" curvature to the processing rolls 11*a*, 11*b*; the actions of these curvature jack means 20*a*, 20*b* balance and cancel each other.

To impart an "OUT" curvature to the lower processing roll 11*a* associated with the block 10, there are actuated the third curvature jack means 20*c* and the compensation jack means 21 to prevent the lower rib 18*a* from being deformed under the action of the third curvature jack means 20*c*.

With the C-shaped block 10 it is possible to alter the diameter of the processing rolls 11 without having constraints of a geometric type caused by the block 10 and the chocks 15 of the processing rolls 11.

In this case, the rolling plane defined by the processing rolls 11 is left unchanged by acting on shims 25 fitted below the chock 16*a* of the lower back-up roll 13*a*.

The processing rolls 11, when they have been correctly curved, are controlled in position by acting on hydraulic actuator capsules 23, which adjust the rolling pass and are associated with an upper cross-member of the housing 24 of the rolling mill stand 12.

Figure 3:
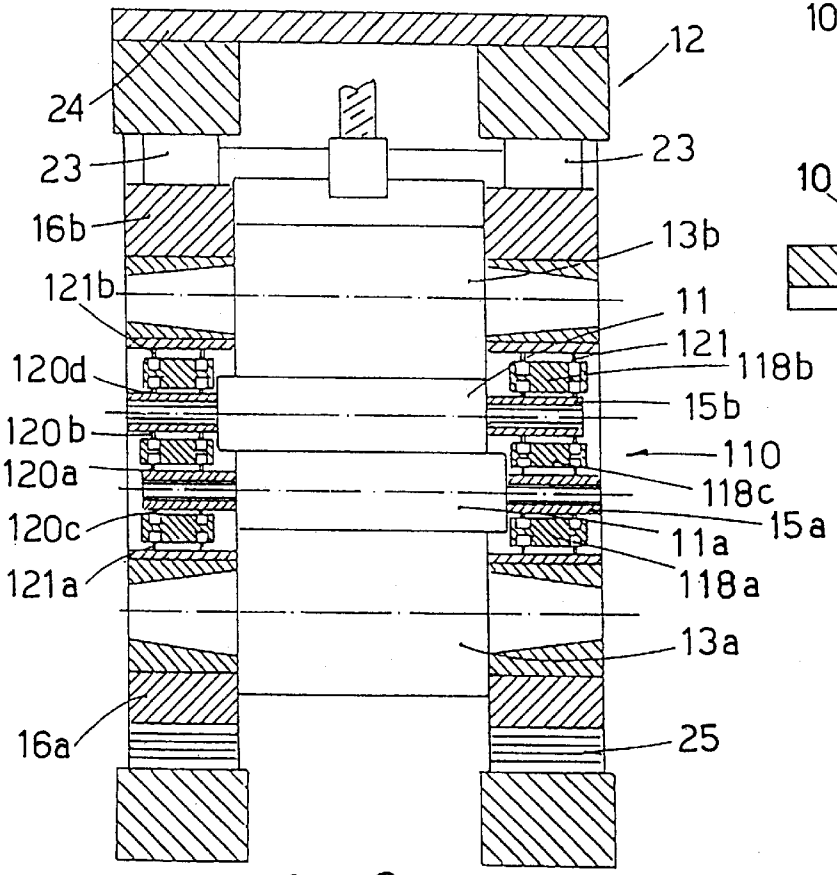
FIG. 3 is a second form of embodiment of the curvature and balancing block according to the invention.
Figure 4:
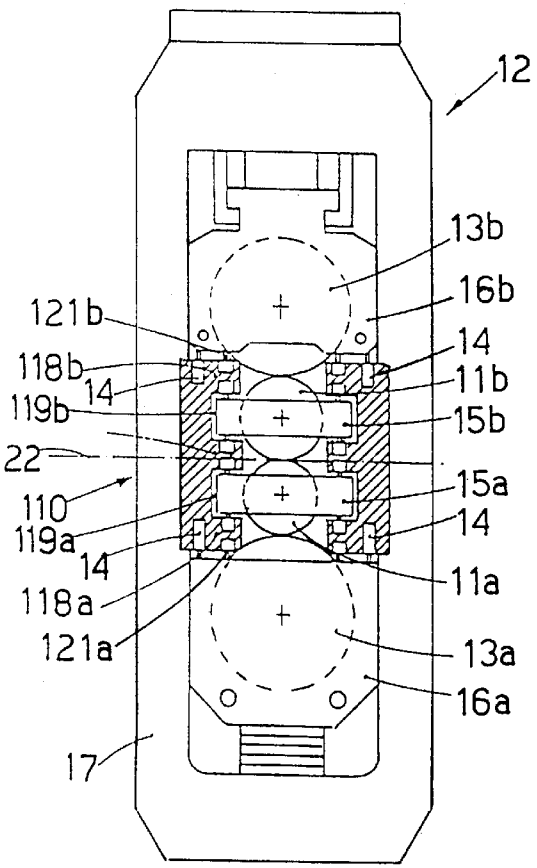
FIG. 4 is a side view of the curvature and balancing block of FIG. 3.

FIGS. 3 and 4 show a second E-shaped form of embodiment of a block 110 providing curvature and balancing.

This E-shaped block 110 includes three ribs 118, namely a lower rib 118*a*, an upper rib 118*b* and a central rib 118*c* respectively, which, two by two, define respective lower 119*a* and upper 119*b* spaces.

In these spaces 119*a*, 119*b* there cooperate respectively a lower chock 15*a* associated with the lower processing roll 11*a* and an upper chock 15*b* associated with the upper processing roll 11*b*.

In this case, there are also included supporting jacks 14 which cooperate with chocks 16*a*, 16*b* of the respective back-up rolls 13*a*, 13*b*.

The E-shaped block 110 includes jack means 120 to provide curvature and jack means 121 to provide compensation.

To be more exact, the central rib 118*c* includes on its two surfaces the curvature jack means 120*a* and 120*b* which are actuated to impart an "IN" curvature to the two processing rolls 11*a*, 11*b*; these two actions cancel each other and thus keep the block 110 substantially undeformed and balanced.

The inner surfaces of the lower rib 118*a* and of the upper rib 118*b* include respective curvature jack means 120*c* and 120*d*, which are actuated to impart an "OUT" curvature to the processing rolls 11; the actions of these curvature jack means 120*c* and 120*d* are balanced by compensation jack means 121*a*, 121*b* associated respectively with the lower surface of the lower rib 118*a* and with the upper surface of the upper rib 118*b*.

It is possible in this way to impart an "IN" or an "OUT" pre-curvature to the processing rolls 11*a*, 11*b* without the curvature and balancing block 110 being unbalanced or subject to great stresses.

According to a special form of embodiment shown in FIGS. 1 and 3 each of the curvature jack means 20, 120 and of the compensation jack means 21, 121 comprises a pair of actuators parallel to each other and spaced apart along the axis of the processing rolls 11.

It is possible in this way to actuate each pair of actuators in such a manner that the result of their actions is substantially always along the same vertical axis passing through the intermediate plane of the chocks 15*a*, 15*b* associated with the processing rolls 11*a*, 11*b*.

In this way are avoided the imbalances due to the axial traversing of the processing rolls 11, for these imbalances would cause the curvature jack means 21, 20 and the compensation jack means 21, 121 to act in a manner offset from the bearings of the processing rolls 11*a*, 11*b*, with a resulting shortening of the working life of those bearings.

Figure 5:
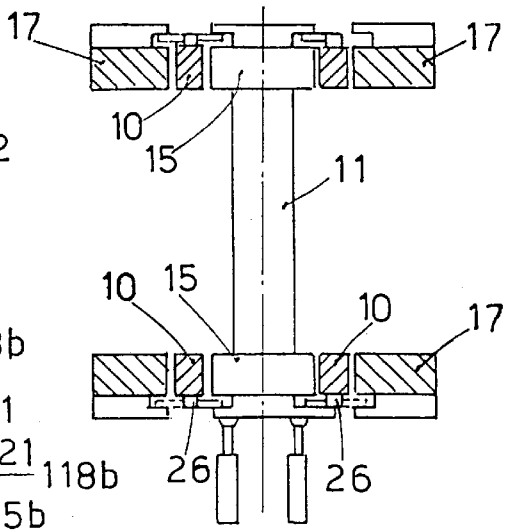
FIG. 5 shows a diagram of a variant of the invention.

In the embodiment shown in FIG. 5, two-positional attachment means 26 are included on the curvature and balancing block 10.

These attachment means 26 in a first position enable the curvature and balancing block 10 to be secured to the relative chock 15 so as to carry out, in the processing step, the shifting of the processing rolls 11, that is to say, the axial movement of the processing rolls 11 so as to change the processing surface of those rolls 11 in relation to the product being processed.

In their second position the attachment means 26 enable the curvature and balancing block 10 to be secured to the relative housing 17.

We claim:

1. Block to provide curvature and balancing, which is suitable to impart an "IN" or "OUT" pre-curvature to at least one processing roll of a four-high rolling mill stand comprising lower and upper processing rolls respectively, each of which cooperates with a relative back-up roll, the processing rolls and back-up rolls cooperating at their two ends with respective chocks and relative bearings, the block comprising at least one lower rib and one upper rib, curvature jacks provided on respective inner surfaces of the at least one lower rib and one upper rib cooperating with the opposite surfaces of the chocks of the processing rolls, supporting jacks cooperating with the chocks of the back-up rolls, and surface compensation lacks provided on at least one rib which are actuated when an "OUT" pre-curvature is imparted to at least one processing roll associated with the block, the compensation jacks acting on the chocks of the corresponding back-up roll.

2. Block to provide curvature and balancing as in claim 1, in which the compensation jacks are substantially coaxial with the curvature jacks.

3. Block to provide curvature and balancing as in claim 1, wherein the block is C-shaped and includes on the inner surfaces of the lower and upper ribs curvature jack, providing curvature and cooperating with the chocks of the processing roll with which the block is associated, the outer surface of one of the ribs including curvature cooperating with the chocks of the other processing roll, whereas the outer surface of the other rib includes compensation jacks cooperating with the chocks cooperating with that outer surface.

4. Block to provide curvature and balancing as in claim 1, wherein the block is E-shaped and includes at least one intermediate rib provided between the upper and lower ribs, both the surfaces of the intermediate rib and the inner surfaces of the lower and upper ribs including curvature jacks cooperating with the chocks that cooperate with those surfaces, the outer surfaces of the lower and upper ribs including compensation jack means cooperating with the chocks that cooperate with those surfaces.

5. Block to provide curvature and balancing as in claim 1, in which the curvature jacks consist of a pair of actuators positioned spaced apart from each other along the axis of the processing rolls.

6. Block to provide curvature and balancing as in claim 1, which cooperates with two-positional attachment means, which have a first position in which they secure the curvature and balancing block to the relative chock, and a second position, in which they secure the curvature and balancing block to the relative housing of the rolling mill stand.

7. A four-high rolling mill stand, comprising: a housing, lower and upper processing rolls respectively, each of which cooperates with a relative back-up roll, the processing rolls and back-up rolls cooperating at their two ends with respective chocks and relative bearings supported by said housing, and a block to provide curvature and balancing, which is suitable to impart an "IN" or "OUT" pre-curvature to at least one processing roll, the block comprising at least one lower rib and one upper rib, curvature jacks provided on respective inner surfaces of the at least one lower rib and one upper rib cooperating with the opposite surfaces of the chocks of the processing rolls, supporting jacks cooperating with the chocks of the back-up rolls, and surface compensation jacks provided on at least one rib which are actuated when an "OUT" pre-curvature is imparted to at least one processing roll associated with the block, the compensation jacks acting on the chocks of the corresponding back-up roll.

* * * * *